United States Patent [19]

Ferguson

[11] Patent Number: 4,541,445

[45] Date of Patent: Sep. 17, 1985

[54] TENT

[75] Inventor: Robert W. Ferguson, Ann Arbor, Mich.

[73] Assignee: Oyster Tent Company, Ann Arbor, Mich.

[21] Appl. No.: 613,700

[22] Filed: May 24, 1984

[51] Int. Cl.[4] ..... A45F 1/16

[52] U.S. Cl. ..... 135/106; 135/105; 135/115

[58] Field of Search ..... 135/101, 102, 105, 106, 135/104, 115, 87; 403/206, 208, 205

[56] References Cited

U.S. PATENT DOCUMENTS

| | | | |
|---|---|---|---|
| 1,965,644 | 7/1934 | Heffelfinger | 403/205 |
| 3,454,021 | 7/1969 | Morris | 135/105 |
| 3,621,857 | 11/1971 | May et al. | 135/102 |
| 3,670,747 | 6/1972 | Pohl et al. | 135/105 |
| 3,834,410 | 9/1974 | Leibel | 135/104 |
| 4,102,352 | 7/1978 | Kirkham | 135/115 |
| 4,197,681 | 4/1980 | Holcombe | 135/101 |
| 4,285,355 | 8/1981 | Lundblade | 135/105 |
| 4,465,087 | 8/1984 | Ferguson | 135/101 |

*Primary Examiner*—Robert A. Hafer
*Assistant Examiner*—Daniel Nolan
*Attorney, Agent, or Firm*—Stephenson and Boller

[57] ABSTRACT

A tent comprises end walls of trapezoidal shape and pole structures which support the tent via the tops of its end walls. A sleeve is provided along the top of each end wall and a ridge pole is disposed within the sleeve, the sleeves and the ridge poles being of essentially identical lengths. The sleeves are provided with openings facing downwardly and longitudinally inwardly, and end-to-end separably connected pole sections support the ends of the ridge poles. Supporting each end of each ridge pole are exactly three end-to-end separably connected pole sections. The lengths of all ridge poles and pole sections are essentially identical and equal to the width across an individual's shoulders whereby the tent can be collapsed into a compact package suitable for backpacking The ridge poles are bowed so as to be concave in an upward and outward sense and right angle fittings provide the connections between the ends of the ridge poles and the end-to-end connected pole sections which support the ends of the ridge poles.

12 Claims, 3 Drawing Figures

TENT

BACKGROUND AND SUMMARY OF THE INVENTION

This invention relates to tents and is particularly concerned with a new and improved construction which provides a sturdy structure when erected yet is collapsible into an espcially compact form for convenient storage and transport, being particularly well suited for backpacking.

Reference is made to the inventor's U.S. Pat. No. 4,271,856 and to his allowed U.S. patent application Ser. No. 519,462, filed Aug. 1, 1983, now U.S. Pat. No. 4,465,087.

Certain functional attributes are desirable in a tent including ease of erection, sturdiness and effectiveness as an outdoor shelter once erected, and compactness when taken down and bundled for transport and/or storage. Where the tent is to be transported by an individual, i.e. backpacking, it is desirable that the tent also be light in weight and adapted for transport on the back of an individual.

From the standpoint of manufacture, it is desirable for a tent not to comprise a complicated construction. For example, minimizing the cutting and seaming of fabric parts which are used to make a tent reduces the fabrication costs and it also reduces the risk of water leakage since seams are in general more susceptible to leakage than is the fabric body. It is also desirable to have adequate interior roomspace for occupant comfort and convenience with a minimal amount of materials.

In certain respects the present invention constitutes an improvement upon a tent which is disclosed in patent application Ser. No. 519,462. Yet, a tent embodying principles of the present invention also possesses unique aspects which are independent of the construction disclosed in that patent application.

While the present invention provides a tent possessing the attributes mentioned above, the invention has certain aspects which contribute to compactness when the tent is collapsed and bundled for transport, particularly for backpacking. One feature of the invention relates to the organization and arrangement of the pole structure for supporting the tent in its erected condition. The pole structure can be disassembled into component parts which are particularly adapted for backpacking; yet these parts can be readily assembled together when the tent is being erected, and when assembled they impart very satisfactory sturdiness in the erected tent. Another advantageous aspect relates to the manner in which connection is made between certain of the pole parts. In particular, use is made of right angle type connector fittings between ridge poles and side poles even though the respective ridge and side poles are at other than a right angle in their general overall arrangement. This aspect is advantageous because the right angle fittings are standard parts, and it therefore avoids the expense of having to make customized parts which are not right angles.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
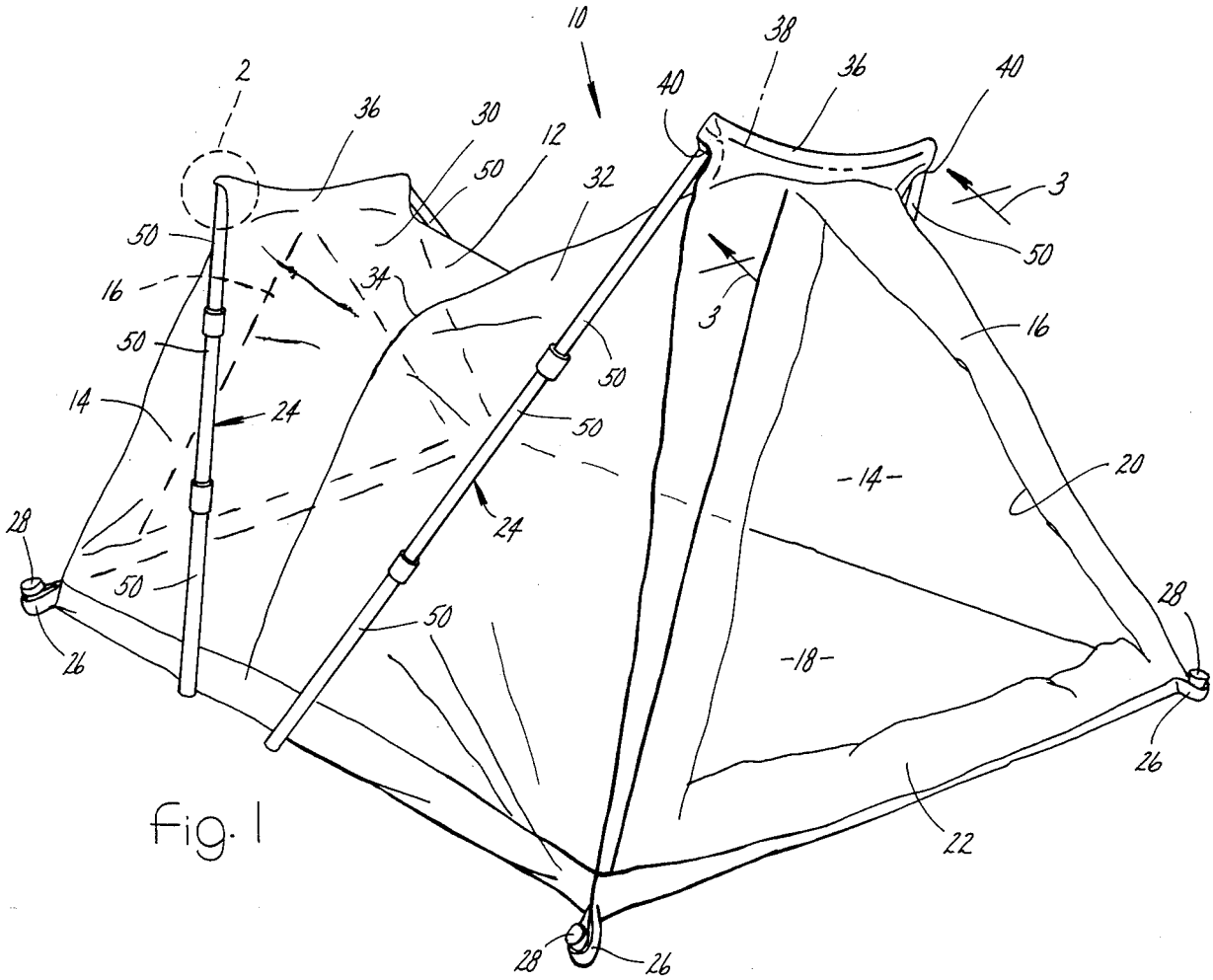
FIG. 1 is a perspective view illustrating a tent embodying principles of the present invention in the erected condition.

FIG. 1 illustrates an erected tent 10 embodying principles of the present invention. Tent 10 comprises a top wall 12, two sidewalls 14 and two end walls 16. It also includes an integral floor 18, but principles of the invention may be practiced whether or not the tent has a floor.

The near end wall 16 in FIG. 1 is shown to comprise an opening 20 of generally triangular shape which is selectably closeable by means of a flap 22. The opposite end wall 16 is essentially identical in overall shape to the near end wall 16, and it preferably includes a screened window and an interior zipper flap. As can be seen in FIG. 1, flap 22 is shown rolled up at the bottom of the near end wall 16.

Tent 10 is constructed from any suitable fabric material.

Tent 10 is supported in its erected condition through the use of two sets of poles which are designated in FIG. 1 by the general reference numerals 24. As will become apparent from the ensuing description, each of the pole sets 24 comprises several component parts.

The bottom of tent 10 has a generally rectangular shape and there are four stake loops 26 at the four corners. Stakes 28 are passed through the four corner loops and driven into the ground.

End walls 16 are of generally trapezoidal shape. The trapezoidal shape is provided by the top and bottom of each end wall being generally horizontal and the side of each end wall inclining upwardly and inwardly from bottom to top so that the top of each end wall is shorter than the bottom.

The top wall 12 and sidewalls 14 are fabricated from two pieces of tent fabric and are identified by the respective reference numerals 30, 32. Each piece 30, 32 joins with a corresponding end wall 16, and the two pieces 30, 32 join together along a continuous seam 34.

Seam 34 is generally of an arch-shape, extending up one sidewall 14, merging in a generally curved fashion into top wall 12, extending across the top wall, merging downwardly into the opposite sidewall 14 and extending down that opposite sidewall. Each of the fabric pieces 30, 32 joins to the corresponding end wall 16 along the top and the two side edges of the end wall.

The tent is supported in the erected condition along the tops of its end walls, or stated another way, along the ends of its top wall where the top wall and end walls merge. A fabric sleeve 36 is provided along the top of each end wall and a ridge pole 38 is disposed within each sleeve. Each sleeve has a length essentially corresponding to the top of the corresponding end wall 16, and the ridge pole is also of corresponding length. Each sleeve 36 is fully enclosed except at its opposite ends where it has openings which are identified by the reference numerals 40. Each set of poles 24 passes through these openings 40 in each sleeve 36.

Figure 2:
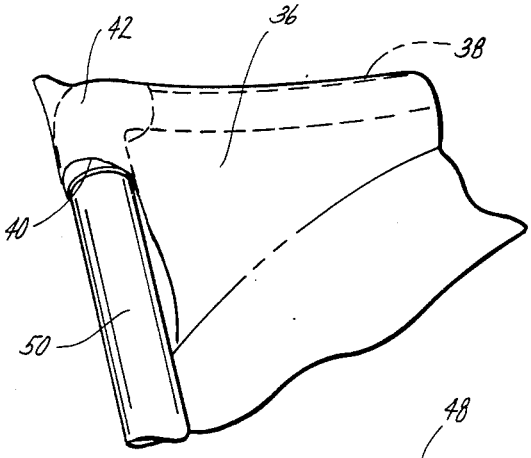
FIG. 2 is a fragmentary perspective view taken generally in the vicinity of circle 2 in FIG. 1 and enlarged.
Figure 3:
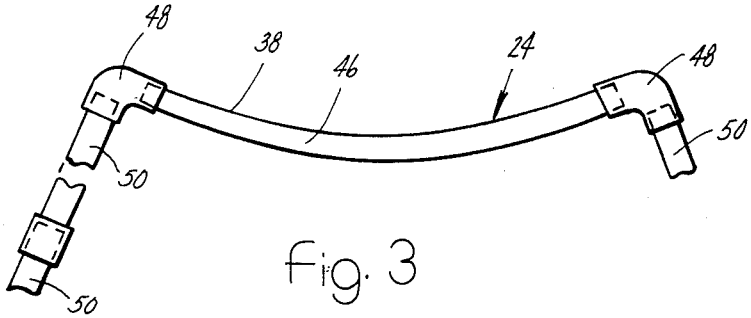
FIG. 3 is a fragmentary view taken generally in the direction of arrows 3—3 in FIG. 1 and enlarged.

Detail of the end of each sleeve can be best seen by considering FIG. 2. In general, each opening 40 may be considered as facing downwardly and longitudinally inwardly from the corresponding end wall, facing toward a point of support for the corresponding pole structure. In other words, each opening 40 faces toward where the corresponding set of poles engages the ground to provide support. Openings 40 are provided by shaping, cutting and stitching the ends of sleeves 36 to form pockets 42 at the upper end corner of the sleeve.

The construction provides for convenience and function both when the tent is erected and when the tent is collapsed and bundled for transport and/or storage.

Each set of poles 24 comprises a plurality of individual parts. One part is the ridge pole 38 which is disposed within sleeve 36. Ridge pole 38 comprises a tube 46 and right angle elbow fittings 48 on its ends. In the erected condition of the tent, each ridge pole is bowed in the manner illustrated so as to be concave in the upwardly and longitudinally outwardly facing direction. Bowing of a ridge pole is obtained either by permanently bowing its tube 46 during manufacturing or by constructing it so that it can be resiliently flexed to the bowed condition when the tent is erected.

When the ridge poles are disposed within the sleeves, elbow fittings 48 are located in corner pockets 42 with the lower ends of the elbows facing downwardly and inwardly in the same sense as opening 40. In this way each ridge pole is located and retained within its sleeve. The ridge poles never need to be removed from their sleeves even when the tent is packed in its carrying bag.

Three pole sections 50 are connected together end-to-end to support the ends of the ridge poles. Hence in the erected tent of FIG. 1 there are twelve such pole sections 50. A socket is provided in one end of each pole section to provide for connection with the end of the immediately adjacent pole section.

Each uppermost pole section 50 connects into a corresponding one of the elbow fittings 48. The pole sections extend from the ridge poles to the ground downwardly and laterally outwardly and longitudinally inwardly. The sets of poles are effective to exert upwardly and outwardly directed forces which act upon the tent via the sleeves which extend along the tops of the end walls. These forces are effective to impart a certain tension to the walls, the tensioning being applied in opposite directions to tension the top and sidewalls to a substantial extent. The tent construction is effective to direct any water falling upon the tent naturally toward the seam and down the sides of the tent.

The individual pole sections 50 and the ridge poles 38 are constructed so as to be of substantially identical lengths. This is particularly useful for transport of the tent when the tent is taken down and bundled, and especially where the tent is backpacked by an individual. The length of each individual pole section 50 and ridge pole 38 is such as to correspond approximately to the width across an individual's shoulders. Hence, the disassembled pole parts, which for the illustrated tent will be fourteen in number, can be arranged on the collapsed tent side by side and the tent folded or rolled up so as to form a compact package whose width is comparable to the length of the individual pole parts.

By using lightweight tent fabric material and through the use of lightweight members for the various pole sections, the overall weight of the tent is kept low and the overall size of the collapsed tent is kept compact. This renders the tent particularly well suited for use by a backpacker. Despite the advantageous packaging characteristics of the tent, it is an effective outdoor shelter which can be readily erected and readily taken down. It is efficient in its use of materials and can be erected without the necessity of additional components other than those which are shown.

Although the tent has been illustrated as being erected on the ground it will be appreciated that it can be erected on other than the ground, for example on a supporting platform or the like attached to a vehicle roof. The poles may be constructed of any suitable plastic or metal, and the tent stakes are conventional.

While a preferred embodiment of the invention has been disclosed, it will be appreciated that principles of the invention are applicable to other embodiments.

What is claimed is:

1. In a tent having a longitudinally extending top wall, longitudinally extending sidewalls, and end walls at longitudinal ends of the top wall and sidewalls, the improvement which comprises said end walls each being of a generally trapezoidal shape with the top and bottom of each end wall being generally horizontal and the sides of each end wall inclining upwardly and inwardly from bottom to top so that the top of each end wall is shorter than the bottom, and means for supporting the tent in erected condition via the top of each end wall comprising a ridge pole extending along the top of each end wall, means attaching the top of each end wall to the corresponding ridge pole, each ridge pole having a length corresponding essentially to that of the top of the corresponding end wall, and pole structures supporting the ends of the ridge poles, each pole structure comprising exactly three end-to-end separably connected pole sections extending between a corresponding end of the corresponding ridge pole and a corresponding point of support which is in longitudinally inwardly spaced relation to the corresponding end wall, all said pole sections and said ridge poles being of substantially identical lengths, said tent comprising two fabric sections each seamlessly forming respective portions of said top wall and said sidewalls, said two fabric sections joining together along a continuous longitudinally central arch-shaped seam which extends up one sidewall, merges into said top wall, extends across said top wall, merges into the opposite sidewall, and extends down said opposite sidewall, said seam being disposed at an elevation which is below that of said ridge poles.

2. The improvement set forth in claim 1 in which each ridge pole is bowed so as to be concave in an upwardly and longitudinally outward facing direction, right angle fittings on the ends of the ridge poles having connecting portions facing downwardly and longitudinally inwardly toward the points of support, said pole sections connecting to said connecting portions of said ridge pole fittings.

3. The improvement set forth in claim 2 in which said means attaching the top of each end wall to the corresponding ridge pole comprises sleeves extending along the tops of said end walls, said ridge poles being disposed within said sleeves, and said sleeves comprising openings to provide for connection of said pole structures to said ridge poles.

4. The improvement set forth in claim 3 including means securing each ridge pole in place within its corresponding sleeve.

5. The improvement as set forth in claim 3 in which said sleeves are fully enclosed except at said openings, each opening facing downwardly and longitudinally inwardly from the corresponding end wall.

6. In a tent having a longitudinally extending top wall, longitudinally extending sidewalls, and end walls at longitudinal ends of the top wall and sidewalls, the improvement which comprises said end walls each being of a generally trapezoidal shape with the top and bottom of each end wall being generally horizontal and the sides of each end wall inclining upwardly and inwardly from the bottom to top so that the top of each end wall is shorter than the bottom, and means for supporting the tent in erected condition via the top of each end wall comprising ridge pole means which extends along the top of each end wall, right angle fittings on the ends of said ridge pole means having connecting portions facing downwardly and longitudinally inwardly toward corresponding points of support, and pole sections extending from said connecting portions of said right angle fittings to the points of support, said tent comprising two fabric sections each seamlessly forming respective portions of said top wall and said sidewalls, said two fabric sections joining together along a continuous longitudinally central arch-shaped seam which extends transversely up one sidewall, merges into said top wall, extends across said top wall, merges into the opposite sidewall, and extends down the opposite sidewall, said arch-shaped seam being disposed at an elevation below the tops of said end walls.

7. The improvement set forth in claim 6 in which said ridge poles are permanently bowed.

8. The improvement set forth in claim 6 in which said pole sections comprise exactly three end-to-end separably connected pole sections extending between each end of each ridge pole and the corresponding point of support, all said pole sections and said ridge poles being of substantially identical lengths.

9. The improvement set forth in claim 6 in which said means for attaching the top of each end wall to the corresponding ridge pole comprises sleeves extending across the tops of said end walls, said ridge poles being disposed within said sleeves, and said sleeves comprising openings to provide for connection of said pole sections to said ridge poles.

10. The improvement set forth in claim 9 including means for securing each ridge pole in place within its corresponding sleeve.

11. The improvement set forth in claim 9 in which said sleeves are fully enclosed except at said openings which face downwardly and longitudinally inwardly from the corresponding end wall.

12. In a tent having a longitudinally extending top wall longitudinally extending sidewalls and end walls at longitudinal ends of the top wall and sidewalls, the improvement which comprises said end walls each being of a generally trapezoidal shape with the top and bottom of each end wall being generally horizontal and the sides of each end wall inclining upwardly and inwardly from bottom to top so that the top of each end wall is shorter than the bottom, and means for supporting the tent in erected condition via the top of each end wall comprising a ridge pole extending along the top of each end wall and pole structures supporting the ends of the ridge poles, said tent comprising an arch-shaped seam disposed longitudinally between said end walls, said seam extending up one sidewall, merging into said top wall, extending across said top wall, merging into the opposite sidewall, and extending down the opposite sidewall, said seam being disposed at an elevation which is below that of said ridge poles, said pole structures engaging points of support adjacent the ends of said seam, and means providing connections between said pole structures and the tent, said connections being at the ends of said seam.

* * * * *